US005791703A

United States Patent [19]

Kritzler et al.

[11] Patent Number: 5,791,703

[45] Date of Patent: Aug. 11, 1998

[54] ACTUATING HANDLE FOR MOTOR-VEHICLE DOOR LATCH

[75] Inventors: Dietmar Kritzler, Lüdenscheid; Damien Labonde, Essen, both of Germany

[73] Assignee: Kiekert AG, Heiligenhaus, Germany

[21] Appl. No.: 796,753

[22] Filed: Feb. 6, 1997

Related U.S. Application Data

[62] Division of Ser. No. 607,085, Feb. 26, 1996, Pat. No. 5,685,581.

[30] Foreign Application Priority Data

Mar. 4, 1995 [DE] Germany ..... 195 075 90.0
Oct. 12, 1995 [DE] Germany ..... 195 379 84.5

[51] Int. Cl.[6] ..... E05B 3/00

[52] U.S. Cl. ..... 292/336.3

[58] Field of Search ..... 292/336.3, 348, 292/347, 356, DIG. 17, DIG. 53, DIG. 64; 70/207; 403/113

[56] References Cited

U.S. PATENT DOCUMENTS

| | | | |
|---|---|---|---|
| 4,580,822 | 4/1986 | Fukumoto | 292/348 X |
| 4,858,973 | 8/1989 | Ogasawara et al. | 292/347 |
| 4,883,296 | 11/1989 | Laurie | 292/DIG. 53 X |
| 5,005,885 | 4/1991 | Kobayashi et al. | 292/336.3 |

FOREIGN PATENT DOCUMENTS

| | | | |
|---|---|---|---|
| 374039 | 6/1990 | European Pat. Off. | 70/207 |
| 3030519 | 2/1982 | Germany | 70/207 |
| 3248964 | 10/1983 | Germany . | |
| 1484798 | 9/1977 | United Kingdom | 403/113 |

*Primary Examiner*—Rodney M. Lindsey
*Attorney, Agent, or Firm*—Herbert Dubno; Andrew Wilford

[57] ABSTRACT

An actuating assembly for a motor-vehicle door latch has a handle extending longitudinally on an outside of the panel and having one end coupled to the latch and another end projecting through the panel and provided with a fork having a longitudinally open seat. A backing plate on an inside of the panel is provided with a transversely extending pivot bar engaged in the seat of the fork. The handle is pivotal about an axis of the bar between a rest position relatively close to the door and an outer actuated position pulled out from the door. Interengaging formations on the bar and in the seat block longitudinal displacement of the handle relative to the backing plate except in the rest position of the handle so that when the handle is moved to or beyond the outer actuated position the formations prevent removal of the handle from the door.

3 Claims, 5 Drawing Sheets

ACTUATING HANDLE FOR MOTOR-VEHICLE DOOR LATCH

CROSS REFERENCE TO RELATED APPLICATIONS

This application is a division of application Ser. No. 08/607,085 now U.S. Pat. No. 5,685,581, filed on Feb. 26, 1996. Filed with a claim to the priorities of German applications 195 07 590.0 filed 4 Mar. 1995 and 195 37 984.5 filed 12 Oct. 1995.

FIELD OF THE INVENTION

The present invention relates to an actuator for a motor-vehicle door latch. More particularly this invention concerns an actuating handle for such a latch.

BACKGROUND OF THE INVENTION

A typical motor-vehicle door latch is actuated by a handle which as described in German patent 3,030,519 of Keller has two main parts, a backing plate that lies against the inside surface of the outer door panel and a handle which lies outside the outer door panel and that engages at both ends through the panel. At one end the handle is coupled to the motor-vehicle door latch, normally via a locking mechanism that can block or uncouple the handle. At the opposite end the handle is mounted inside the door on a pivot formed by the backing plate.

While such a mechanism is fairly simple it constitutes a particularly easy point of attack for an unauthorized unlocking of the door. A would-be thief need merely pull the handle forcibly outward, typically with a pry bar, so that it can be removed completely from the door, leaving a hole through which access can be gained to the latch and lock mechanism. A tool such as a screwdriver can be inserted into the thus created hole to actuate the latch and open the door.

Another problem is that if the door is damaged somewhat, it is possible for the handle to become unhooked from its pivot and fall off, making it impossible to open the door from outside. This is particularly disadvantageous in an accident since it may make it very difficult to open the door and aid an injured passenger.

German patent 3,248,964 of Grabner proposes a partial solution of the problem in that the handle is formed with a lobe that interfits with structure of the backing plate so that the two cannot be separated without destroying one or the other. While this arrangement is fairly effective, it is quite complex to manufacture and rather difficult to install in the vehicle.

OBJECTS OF THE INVENTION

It is therefore an object of the present invention to provide an improved actuating assembly for a motor-vehicle door latch.

Another object is the provision of such an improved actuating assembly for a motor-vehicle door latch which overcomes the above-given disadvantages, that is which makes it effectively impossible to pull the handle off the door and that is nonetheless of simple construction and easy to assemble.

SUMMARY OF THE INVENTION

An actuating assembly for a motor-vehicle door latch has according to the invention a handle extending longitudinally on an outside of the panel and having one end coupled to the latch and another end projecting through the panel and provided with a fork having a longitudinally open seat. A backing plate on an inside of the panel is provided with a transversely extending pivot bar engaged in the seat of the fork. The handle is pivotal about an axis of the bar between a rest position relatively close to the door and an outer actuated position pulled out from the door. Interengaging formations on the bar and in the seat block longitudinal displacement of the handle relative to the backing plate except in the rest position of the handle so that when the handle is moved to or beyond the outer actuated position the formations prevent removal of the handle from the door.

This is an extremely simple mechanism that effectively prevents removal of the door handle by locking the handle to the backing plate when the handle is pivoted out. Thus a would-be thief can pry out the handle, but will be unable to separate it from the door to gain access to the latch mechanism. Similarly in an accident the handle will remain in place, even if the door is deformed somewhat. It is a relatively simple matter to provide the formations on the bar and in the seat and they do not add perceptibly to the construction cost of the parts or the difficulty assembling them.

According to the invention the formation on the handle is a transversely open recess and the formation on the backing plate is a transversely directed barb. The bar has a part-cylindrical front part and a ridged rear part forming the barb.

In accordance with another feature of the invention the plate is formed with a crosspiece extending parallel to but spaced from the pivot bar. The crosspiece is formed with a transversely open notch and the fork is formed with a transversely projecting tooth engaging in the notch when the handle is moved out of the rest position. Either way the backing plate is unitarily formed with the pivot bar and respective formation. The seat and bar have generally equal transverse widths, normally with the width of the seat slightly greater than that of the bar to allow some unimpeded pivoting, so that when the bar is canted in the seat the formations jam together.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
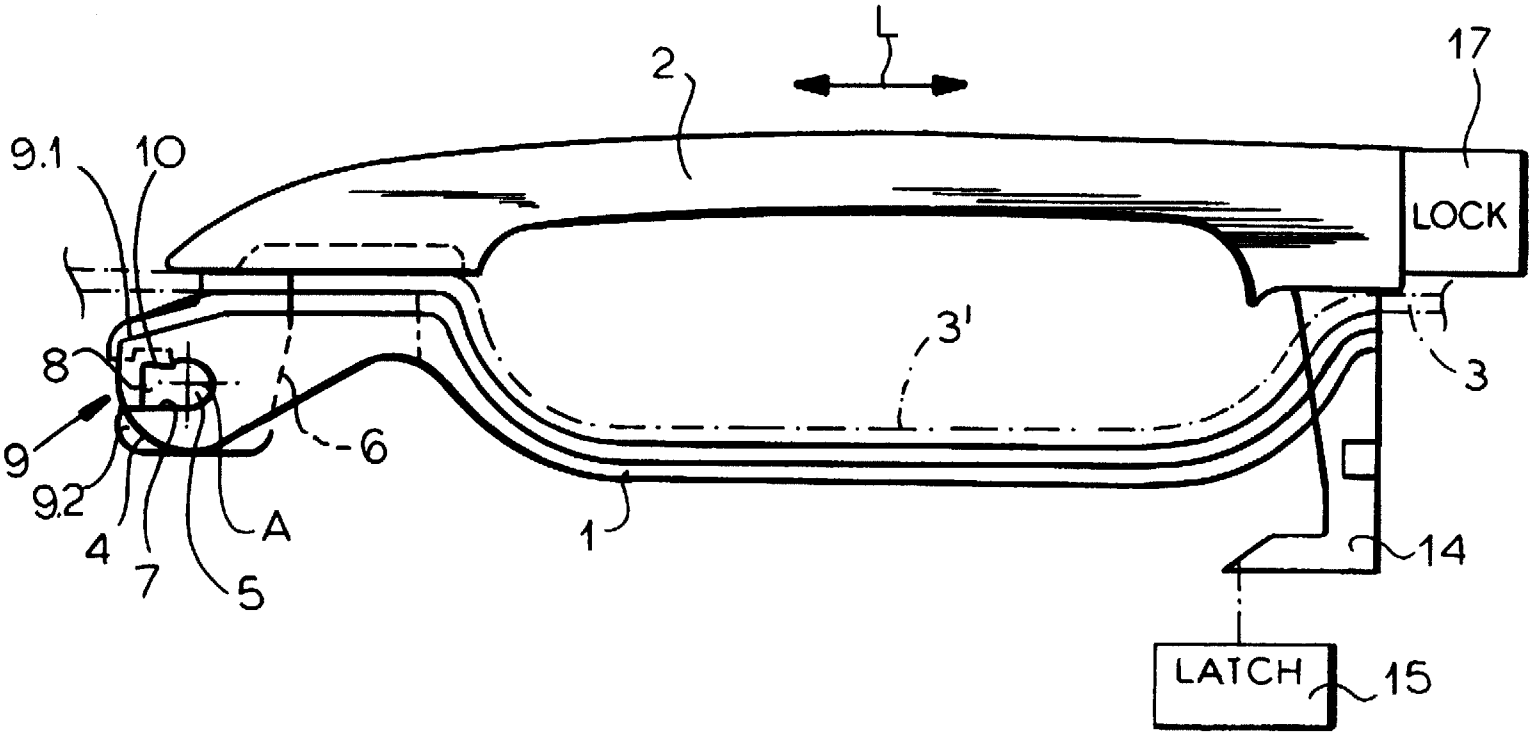
FIG. 1 is a top view of the handle assembly according to the invention.

As seen in FIG. 1 an actuating handle assembly for a motor-vehicle door latch shown schematically at 15 has two parts, a backing plate 1 and a handle 2 both normally made of cast metal. The plate 1 lies against the inside surface of an outside door panel 3 at a hand recess 3'therein and the handle 2 lies substantially outside the panel 3 but engages through it at one end with an arm 14 that acts on the latch 15 and at the other end with a pivot fork 6.

The backing plate 1 is formed with a pair of spaced but parallel mounts 4 bridged by a pivot pin or bar 5 extending along an axis A that is crosswise to a longitudinal direction L of the handle 2. The fork 6 of the handle 2 is formed with a mouth or seat 7 that engages over the pivot pin 5 so that the handle 2 can pivot about the axis A. During normal use the handle 2 is pivoted against the force of an unillustrated spring from the normal or rest position of FIG. 1 to the actuated or open position of FIG. 2. Such movement normally actuates the latch 15 to open the door having the panel 3.

Figure 2:
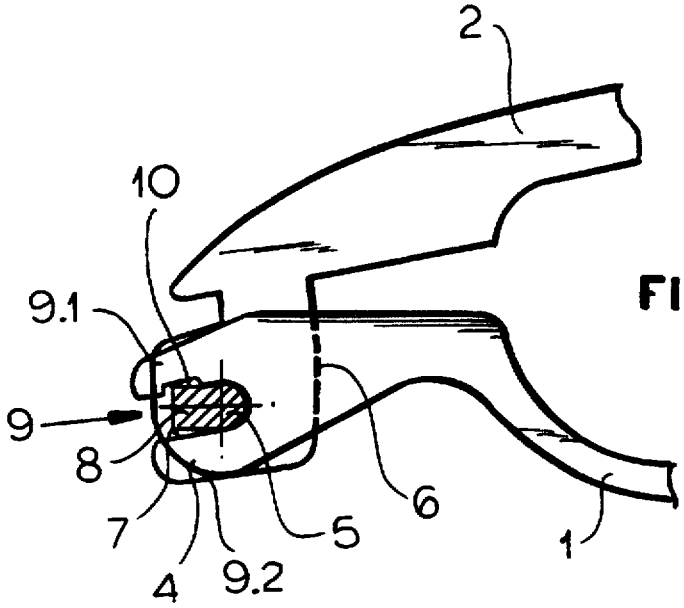
FIG. 2 is a view of a detail of the handle assembly in the normal actuated position.
Figure 3:
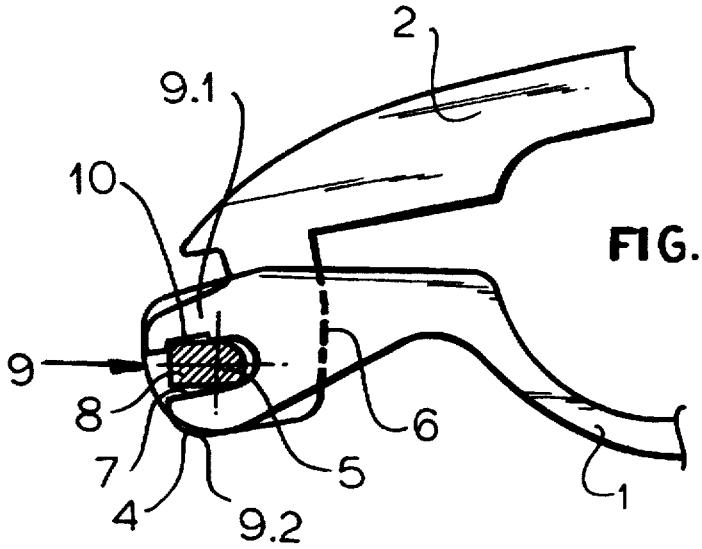
FIG. 3 is a view like FIG. 2 showing the assembly when moved beyond the normal actuated position of FIG. 2.
Figure 4:
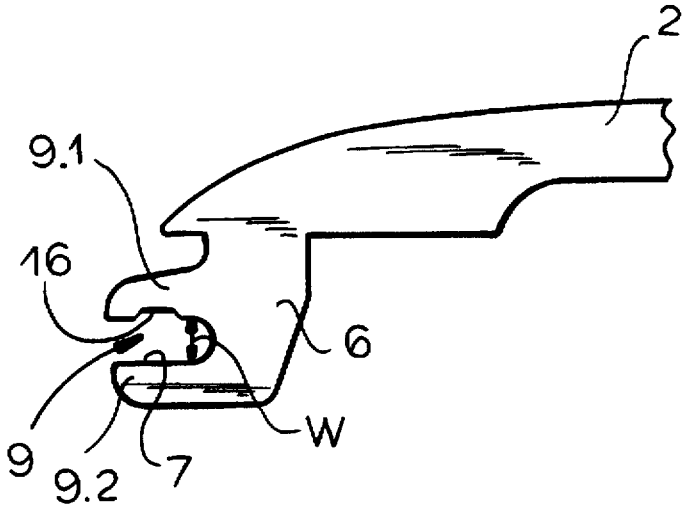
FIG. 4 is a detail view of the handle-part of the assembly.
Figure 5:
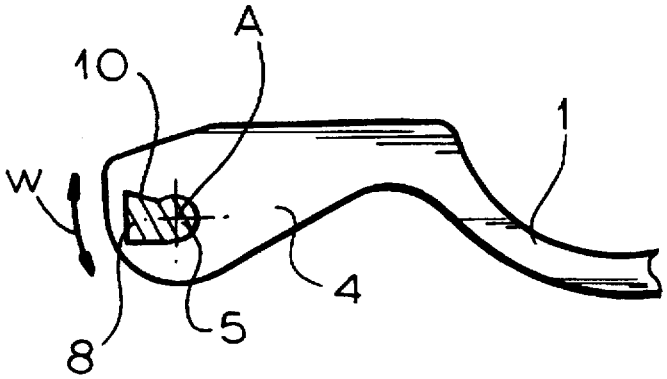
FIG. 5 is a detail view of the pivot part of the assembly.

According to the invention the pivot 5 and the fork 6 are provided with respective formations 8 and 9 that interact when the handle 2 is moved out to or beyond the open position as shown in FIGS. 2 and 3. More specifically as shown best in FIGS. 4 and 5 the pivot 5 is formed with a laterally projecting barb or ridge 10 and one jaw or side 9.1 of the fork 6 is formed with a cutout or recess 16. The pivot bar 5 has a maximum transverse width which is slightly less than the corresponding transverse width of the seat 7 measured perpendicular to the longitudinal direction L between the jaws 9.1 and 9.2 of the fork 6. Thus the handle 2 can be slipped into position over the pivot by movement parallel to the direction L during assembly of the vehicle, after which a lock mechanism 17 is normally installed at the front end of the assembly to prevent it from moving back in this direction L.

On the other hand when the handle 2 is pivoted out as shown in FIGS. 2 and 3 the barb 10 engages in the recess 16 and solidly locks the handle 2 to the pivot 5. Moving the handle 2 longitudinally off the pivot 5 in these positions is only possible with deformation and/or destruction of the parts, something that requires considerable force applied in a manner that is very difficult to do. Thus a would-be thief who pries out the front end of the handle 2 will not be able to get it off the pivot 5 and out of the way. Furthermore in an accident the handle 2 will stay attached to the mechanism and improve the chances that it will still operate to open the door.

Figure 6:
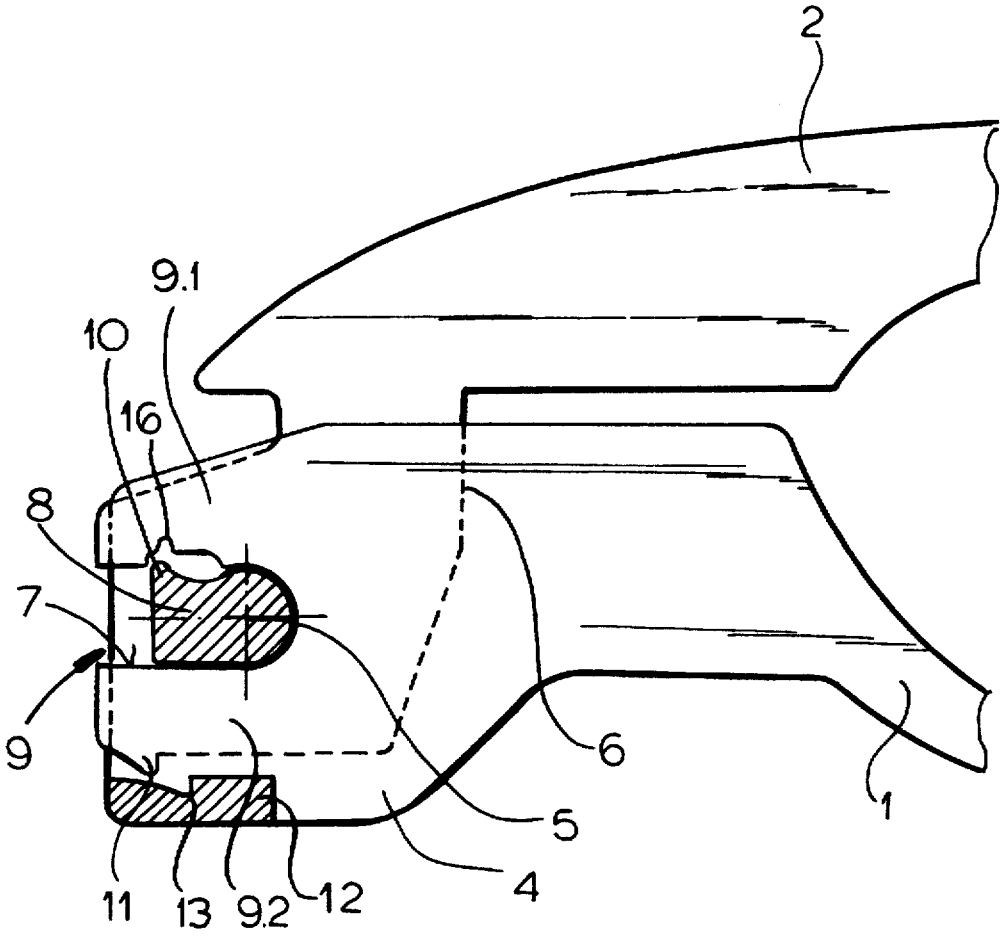
FIGS. 6 and 7 are views like FIGS. 2 and 3, respectively, showing a variant on the latch assembly according to the invention.
Figure 7:
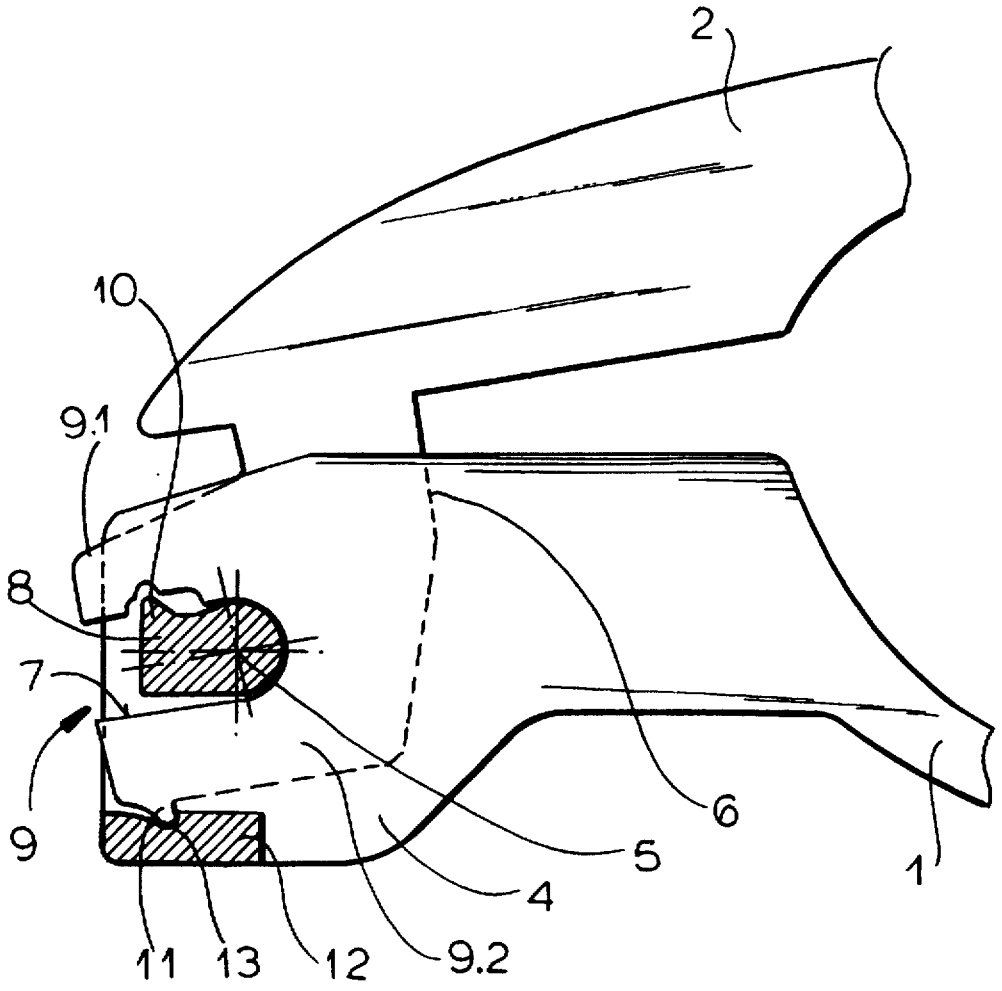

FIGS. 6 and 7 show an alternative where the pivot mounts 4 carry a second crosspiece 12 formed with a notch 13 into which can engage a tooth 11 of the lower cheek 9.2 of the fork, 6. Thus as shown in FIG. 7 in the out position of the handle 2 both the barb 10 and the tooth 11 engage in the respective recesses 16 and 13, solidly blocking the handle 2 in place.

We claim:

1. In a motor-vehicle door having a door panel and a latch, a latch-actuating assembly comprising:

a handle extending longitudinally on an outside of the panel and having one end coupled to the latch and another end projecting through the panel and provided with a fork having a longitudinally open seat having a predetermined transverse width;

a backing plate on an inside of the panel and provided with a pair of spaced mounts and with a transversely extending and at least partially cylindrical pivot bar extending between the mounts and engaged in the seat of the fork, the handle being pivotal about an axis of the bar between a rest position relatively close to the door panel and an outer actuated position pulled out from the door panel;

a transversely projecting sharp-edged barb formed on the pivot bar, the bar having at the barb a predetermined transverse width at most equal to the transverse width of the seat;

a transversely open recess formed in the seat in transverse alignment with the barb, the barb engaging in the recess and blocking longitudinal displacement of the handle relative to the backing plate except in the rest position of the handle, the barb and recess being relatively oriented such that when the handle is moved to or beyond the outer actuated position the barb engages in the recess and prevents removal of the handle from the plate and in the outer actuated position the barb engages a surface of the recess and inhibits further outward movement of the handle.

2. The latch-actuating assembly defined in claim 1 wherein the backing plate is unitarily formed with the pivot bar and barb.

3. The latch-actuating assembly defined in claim 1 wherein the bar has a part-cylindrical front part and a ridged rear part forming the barb.

* * * * *